US005309747A

United States Patent [19]

Yasui

[11] Patent Number: 5,309,747

[45] Date of Patent: May 10, 1994

[54] USING EXHAUST GAS MASS FLOW RATE TO CONTROL SUPERPLASTIC FORMING

[75] Inventor: Ken K. Yasui, Huntington Beach, Calif.

[73] Assignee: McDonnell Douglas Corporation, Long Beach, Calif.

[21] Appl. No.: 12,788

[22] Filed: Feb. 3, 1993

Related U.S. Application Data

[63] Continuation of Ser. No. 801,050, Dec. 3, 1991, abandoned.

[51] Int. Cl.[5] ..... B21D 26/02

[52] U.S. Cl. ..... 72/60; 72/20; 72/342.1; 72/709

[58] Field of Search ..... 72/20, 38, 60, 342.1, 72/364, 709

[56] References Cited

U.S. PATENT DOCUMENTS

| | | | |
|---|---|---|---|
| 4,233,829 | 11/1980 | Hamilton et al. | 72/38 |
| 4,352,280 | 10/1982 | Ghosh | 72/38 |
| 4,489,579 | 12/1984 | Daime et al. | 72/38 |
| 4,708,008 | 11/1987 | Yasui et al. | 72/60 |
| 5,007,265 | 4/1991 | Mahoney et al. | 72/37 |
| 5,129,248 | 7/1992 | Yasui | 72/60 |

FOREIGN PATENT DOCUMENTS

| | | | |
|---|---|---|---|
| 3125367 | 1/1983 | Fed. Rep. of Germany . | |
| 197021 | 8/1989 | Japan | 72/709 |
| 210130 | 8/1989 | Japan | 72/60 |
| 150085 | 1/1962 | U.S.S.R. | 72/60 |

*Primary Examiner*—David Jones

*Attorney, Agent, or Firm*—James M. Skorich; Gregory A. Cone; John P. Scholl

[57] ABSTRACT

A forming die which includes a die cavity contains a forming blank composed of a metallic alloy having superplastic properties. The forming pressure in a pressurized space adjacent the forming blank is regulated by a pressure regulator. The volume of the die cavity is determined, as is the mass of gas initially contained in the die cavity at the beginning of the forming cycle. The total forming time is empirically determined. The average gas mass flow rate that will be exhausted from the die cavity is calculated by dividing the total mass of gas initially contained in the die cavity by the total forming time. A gas mass flow meter fluidly communicates with the die cavity and measures the mass flow rate of the gas displaced by the forming blank and exhausted from the die cavity. The gas mass flow meter is continuously monitored during the forming cycle or a gas mass flow rate signal is fed back to the pressure regulator. The forming pressure is regulated by the pressure regulator so that the gas mass flow rate exhausted from the die cavity approximates the predetermined average gas mass flow rate.

30 Claims, 2 Drawing Sheets

USING EXHAUST GAS MASS FLOW RATE TO CONTROL SUPERPLASTIC FORMING

This is a continuation of application Ser. No. 07/801,050, filed Dec. 3, 1991 and now abandoned.

BACKGROUND OF THE INVENTION

1. Field of the Invention

This invention relates to the field of superplastic forming and, more particularly, to the forming of objects from metallic alloys which exhibit superplastic characteristics when heated to particular temperature ranges.

2. Description of the Prior Art

Certain metallic alloys will exhibit superplasticity when heated to known temperature ranges. This characteristic is used to form objects from such alloys by placing a metallic alloy blank in a forming die containing a die cavity, heating the blank to the desired temperature, and then applying a pressure differential to the blank for a period of time. The pressure differential, also known as the forming pressure, is obtained by introducing a pressurized inert gas into the die cavity on one side of the blank while the cavity on the other side of the blank contains inert gas fluidly communicating with the ambient atmosphere, and thus remains at atmospheric pressure. The forming pressure forms the heated blank to the shape of the die cavity or to the shape of a male die located in the die cavity.

Forming pressure and strain rate are related variables. A forming schedule, also called a pressure forming cycle, provides the forming pressure as a function of time. Although there are different ways of deriving such a forming cycle, it is typically calculated by assuming that the strain rate remains constant during the forming cycle at a value that will not cause rupture, yet is high enough to achieve the desired forming within a reasonable period.

The forming pressure, P, is a function of the forming stress, $\sigma$, instantaneous thickness, T, and instantaneous radius of curvature, R, of the forming blank. This relationship can be expressed as $$P=f_1(\sigma,T,R)$$

The thickness, T, and radius or curvature, R, are functions of a forming progress parameter, h. Thus, the forming pressure can be expressed as $$P=f_2(\sigma,h)$$

The time, t, required for the blank to strain to a particular thickness, T, is a function of the thickness, T, and strain rate, $\dot{\epsilon}$:

$$t=g_1(T,\dot{\epsilon})$$

Since the thickness, T, is a function of the forming progress parameter, h, the equation for time, t, can also be written as $$t=g_2(h,\dot{\epsilon})$$

Solving the foregoing equation for the forming progress parameter, h:

$$h=j(t,\dot{\epsilon})$$

Substituting the foregoing expression for the forming progress parameter, h, into the latter equation for the forming pressure, P, provides the following equation:

$$P=f_3(\sigma,t,\dot{\epsilon})$$

The forming stress, $\sigma$, is a function of the strain rate, $\dot{\epsilon}$. The relationship between these two variables is empirically known for most metallic alloys, or can be obtained from a forming test. When the strain rate, $\dot{\epsilon}$, is chosen for constant strain rate forming, the stress, $\sigma$, can thus be determined and is also assumed to be a constant. Thus, as these two variables are assumed to be constants, the equation for forming pressure, P, simplifies to one where the forming pressure, P, can be expressed solely as a function of time, t:

$$P=f_4(t)$$

A plot of forming pressure, P, versus time, t, can be generated from this equation, bearing in mind that this is the forming pressure required to maintain the constant value of strain rate, $\epsilon$, that was initially chosen.

An example of the foregoing type of approach is provided in U.S. Pat. No. 4,233,829 by Hamilton et al. As can be seen, the calculations necessary to produce the forming pressure versus time plot are complex and very time consuming, even for the simple geometry of a rectangular pan.

Hamilton et al further disclose apparatus for automatically supplying the forming pressure called for by the pressure versus time plot to the die cavity. Others, using similar methods of mathematical analysis, also have produced pressure versus time plots and then used other means to adjust the forming pressure with time in accordance with their pressure plots.

The problem inherent to the foregoing approaches is that any mathematical model used to obtain a plot of forming pressure versus time is only an approximation because the assumed value for the strain rate used in the model cannot be determined with any degree of certainty. A further critical assumption is that the strain rate remains constant whereas, in fact, it varies during the forming cycle.

The foregoing approaches also assume that the strain rate is the same over the entire surface of the blank, whereas it actually varies from point to point over the blank due to the blank's varying geometry during forming, variations in thickness, and temperature gradients. Another factor contributing to inaccuracy is that the superplasticity for the metallic alloy will vary among blanks composed of the same alloy due to innate variations in the production process.

The problems inherent to using a pressure versus time plot in superplastic forming are best explained by means of the example shown in FIGS. 1 and 2. FIG. 1 shows the superplastic forming of a deep cup in a deep cylindrical die cavity. A deep cup has a ratio of its depth to its radius that is greater than one. FIG. 2 is a graph of the actual forming pressure as a function of time for the superplastic forming of the deep cup shown in FIG. 1. The strain rate was kept as near as possible to a constant value.

To better understand FIGS. 1 and 2, one must bear in mind that as the blank strains, its radius of curvature decreases and, with the decreased radius, the forming pressure required to maintain a constant strain rate increases; and as the blank strains it thins, and with this thinning the forming pressure required to obtain a constant strain rate decreases. Initially, the blank is flat, thus having an infinite radius. This beginning position is shown in both figures as point 0. As the forming begins, the blank thins and spherically expands to a slight radius, as indicated by point 1. Through point 1 the radius is decreasing at a rate greater than the rate that the thickness is decreasing, and thus the forming pressure required to maintain a constant strain rate is increasing.

Through point 2 the radius continues to decrease at a rate greater than the thickness is decreasing, and so the required forming pressure continues to increase. At point 3 the blank forms a hemisphere. From point 3 to point 4, where the center of the blank first touches the bottom of the die cavity, the radius remains constant. As the thickness of the blank continues to decrease, the required pressure also decreases. The pressure thus reaches a local maximum at point 3, and steadily decreases thereafter until reaching point 4.

After contacting the bottom of the die cavity, the blank begins to form into the corner of the die cavity, with the result that the radius again decreases at a greater rate than the thinning of the thickness. The required pressure thus forms a local minimum at point 4, and thereafter increases as the corner is being formed at point 5. The pressure continues to increase until the corner is formed against the die radius at point 6 and the forming cycle ends.

As previously discussed, the forming pressure is typically regulated according to a pressure versus time plot derived by attempting to achieve a constant strain rate and applying the methodology of the prior art. There are two modes which may lead to excessive strain resulting in rupture of the blank: fast forming and slow forming.

In the former, the blank expands faster than anticipated due to the combined inaccuracies inherent to the methodology of the prior art that have been previously discussed. The blank thus enters the constant radius zone between points 3 and 4 of FIG. 1 before anticipated and thus during the period when, although the required pressure is decreasing, the pressure being applied pursuant to the pressure versus time plot is being increased until the local maximum is reached at point 3 of FIG. 2. The applied pressure thus becomes progressively higher than the pressure necessary to produce the desired constant strain rate, resulting in a strain rate which may exceed the rate that the blank can withstand.

In the extreme case, the blank may have a strain rate so high that it ruptures even before it reaches point 3 of FIG. 1.

If rupture has not occurred by time point 3 is reached on the pressure versus time plot of FIG. 2, the differential between the applied pressure and the pressure necessary to produce the desired constant strain rate will continue to widen, albeit at a lower rate, because the higher than anticipated strain rate will cause thinning to occur at a greater rate than would normally be the case, thus further reducing the required pressure and concomitantly increasing the strain rate. Rupture may occur at any time until the blank touches the bottom of the cavity and the required pressure begins to increase.

The slow forming mode occurs when the blank forms slower than anticipated. The local maximum for the applied forming pressure occurring at point 3 of FIG. 2 thus occurs before the blank actually reaches point 3 in FIG. 1. The pressure is thus decreased early, before the blank enters the constant radius zone between points 3 and 4 of FIG. 1. The result is that the forming lags even further behind the positions anticipated by the pressure versus time plot of FIG. 2.

The problem occurs when the pressure versus time plot reaches point 4 and the pressure is rapidly increased. At that time, the blank will probably lie between points 2 and 3 or between points 3 and 4 of FIG. 1. In the former case, the increased pressure will cause the blank to more rapidly strain and quickly enter the zone between points 3 and 4. Regardless of whether the blank subsequently strains into the foregoing zone or is already there by the time point 4 is reached on the pressure versus time plot of FIG. 2, the increasing forming pressure results in a drastically increased strain rate in this zone. The differential between the applied pressure and the pressure required to maintain the desired constant strain rate increases, and with it the strain rate, until either rupture occurs or the blank touches the bottom of the die cavity and the required pressure begins to increase.

A further drawback inherent to the use of a pressure versus time plot is that if the forming must be stopped for any reason, such as a malfunction of equipment, it is not possible to determine how much further forming will have progressed while the pressure was held constant, or even reduced, during the interruption. Continuing the forming cycle after an interruption thus increases the risk of rupture.

Efforts have been made to monitor the deformation of the blank so that the pressure can be adjusted to take into account deviation of the actual position of the forming blank from the predicted position, and avoid rupture due to this problem. For example, in U.S. Pat. No. 4,489,579 Daime et al show a hollow tube slideably projecting into the die cavity and having one end in contact with the blank in order to measure the distortion of the blank. Electrical monitoring devices are situated at each recess angle of the die cavity to inform of the arrival of the blank. Further, Japanese Patent No. 1-210130 issued to Hisada shows a touch sensor slideably projecting into the die cavity. The sensor comes into contact at only one point on the blank, and thus would not be able to indicate how the blank is forming in corners or other recesses in the die cavity.

Both of the foregoing approaches require breaching the die cavity, and thus add mechanical complexity and expense to the forming die. Furthermore, both require having a sensor in contact with the forming blank. This will result in the area of the blank in contact with the sensor being prevented from forming normally, thus affecting the strain rate and causing a discontinuity in material thickness in the formed object between the area that was in contact with the sensor and the adjacent area.

In U.S. Pat. No. 5,007,265 Mahoney et al use a video camera to view reference marks on the blank and thereby monitor its strain. The device described therein thus requires a special forming die having a window to allow observation of the forming blank. Such a special forming die would clearly be more expensive to fabricate than a conventional forming die. A further drawback is that the blank must be continually observed by the operator during the forming process, and therefore the use of the described apparatus does not lend itself to automation.

Computer programs have been created to predict the progress of the superplastic forming of a blank. However, the accuracy of these programs is no better than the accuracy of the input data of the original thickness of the blank and the slippage of the blank after it comes into contact with the surface of the die cavity. Further error is introduced by the failure of these programs to compensate for the effect on strain rate and thickness caused by variations in the temperature from point to point over the blank, in addition to changes in the temperature that inevitably occur with time throughout the forming cycle.

Another approach to controlling superplastic forming is shown by Yasui in U.S. patent application Ser. No. 636,791, now U.S. Pat. No. 5,129,248. Yasui is also the inventor of the present invention. The foregoing application is assigned to the same assignee as the present application. The aforementioned application shows controlling the rate of forming by measuring and regulating the flow rate of gas mass into the forming die. The apparatus and method shown therein present an advance over controlling forming by regulating pressure according to a plot of pressure versus time because they do not rely on the assumption that an empirically determined strain rate remains constant during the forming process and over the entire forming blank. The possibility of rupture inherent to the use of the pressure versus time plot is thus avoided for the reasons previously discussed herein.

In U.S. Pat. No. 4,708,008 Yasui et al show an apparatus for controlling the superplastic forming of a blank by continuously monitoring the height of liquid in a manometer fluidly communicating with the gas being displaced and exhausted from a forming die cavity during forming, and by regulating the forming pressure responsive to the height of the liquid in the manometer. Yasui is also the inventor of the present invention, and the foregoing patent is assigned to the same assignee as the present application.

Before forming is begun, the use of the aforementioned device requires an empirical or mathematical analysis to determine the relationship between the forming pressure and the location of the blank as it is forming. The relationship between the location of the blank and the displaced volume of the exhaust gas is then determined. The displaced volume is then converted into exhaust pressure, and the exhaust pressure is converted into the height of liquid in a manometer fluidly communicating with the exhaust gas. The foregoing relationships are used to derive the relationship between forming pressure and the height of liquid in the manometer, which is the relationship used to guide the forming process. The foregoing analyses are complex even for formed objects having the simplest of shapes.

SUMMARY OF THE INVENTION

The volume of the die cavity is firstly determined. Since the gas initially contained in the die cavity is at the forming temperature and at ambient atmospheric pressure, the mass of this gas can be calculated. The mass of the gas initially contained in the die cavity at the beginning of the forming cycle is the gas mass displaced and forced out of the die cavity during the forming cycle.

The time required to complete the forming cycle, also known as the forming cycle period, is empirically determined based on the geometry of the object to be formed and the properties of the alloy of which the blank is composed. The average gas mass flow rate that will be exhausted from the die cavity is calculated by dividing the total mass of gas that will be forced out of the cavity during the forming cycle, by the forming cycle period.

A gas mass flow meter fluidly communicating with an exhaust port in the die cavity continuously measures the instantaneous mass flow rate of gas displaced by the forming blank and forced out of the exhaust port. The gas mass flow meter is monitored during the forming cycle or a gas mass flow rate signal is fed back to a pressure regulator. The forming pressure is regulated so that the gas mass flow rate exhausted from the cavity approximates the predetermined average gas mass flow rate.

The invention is a relatively simple method and apparatus for determining and applying a superplastic forming cycle that will form the desired object in a period that is shorter than the period used by the forming processes of the prior art, without creating a strain rate that will cause the blank to rupture. It avoids the inaccuracy and removes the concomitant risk of rupture inherent to the more complex forming methods of the prior art, and does so without using slideable tubes projecting into the die cavity or sensors located in the die cavity. Furthermore, the invention does not require a series of complex empirical or mathematical analyses before forming to determine the relationship between forming pressure and time or between forming pressure and the height of liquid in a manometer.

DETAILED DESCRIPTION OF AN EMBODIMENT

Figure 1:
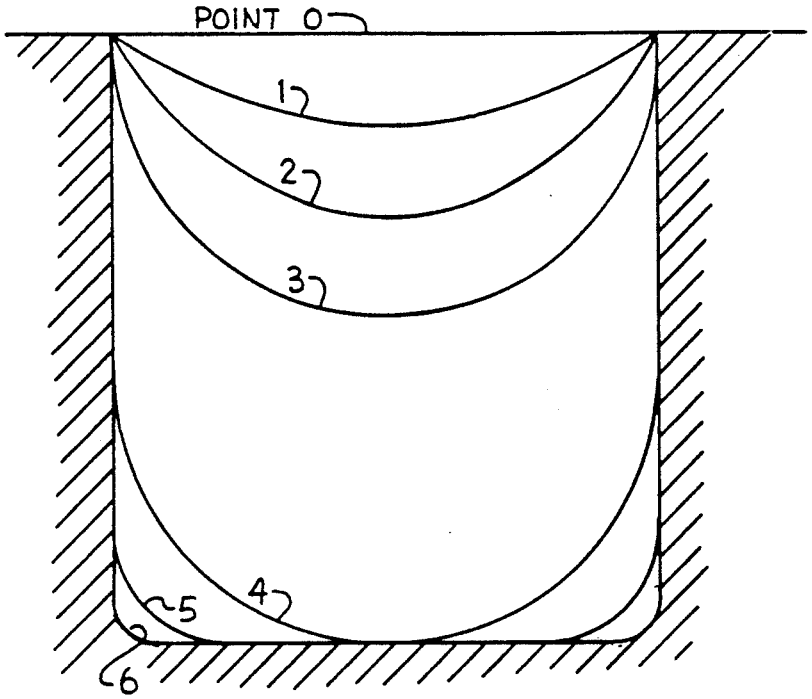
FIG. 1 (PRIOR ART)
FIG. 1 shows the forming of a deep cup in a superplastic forming apparatus.
Figure 2:
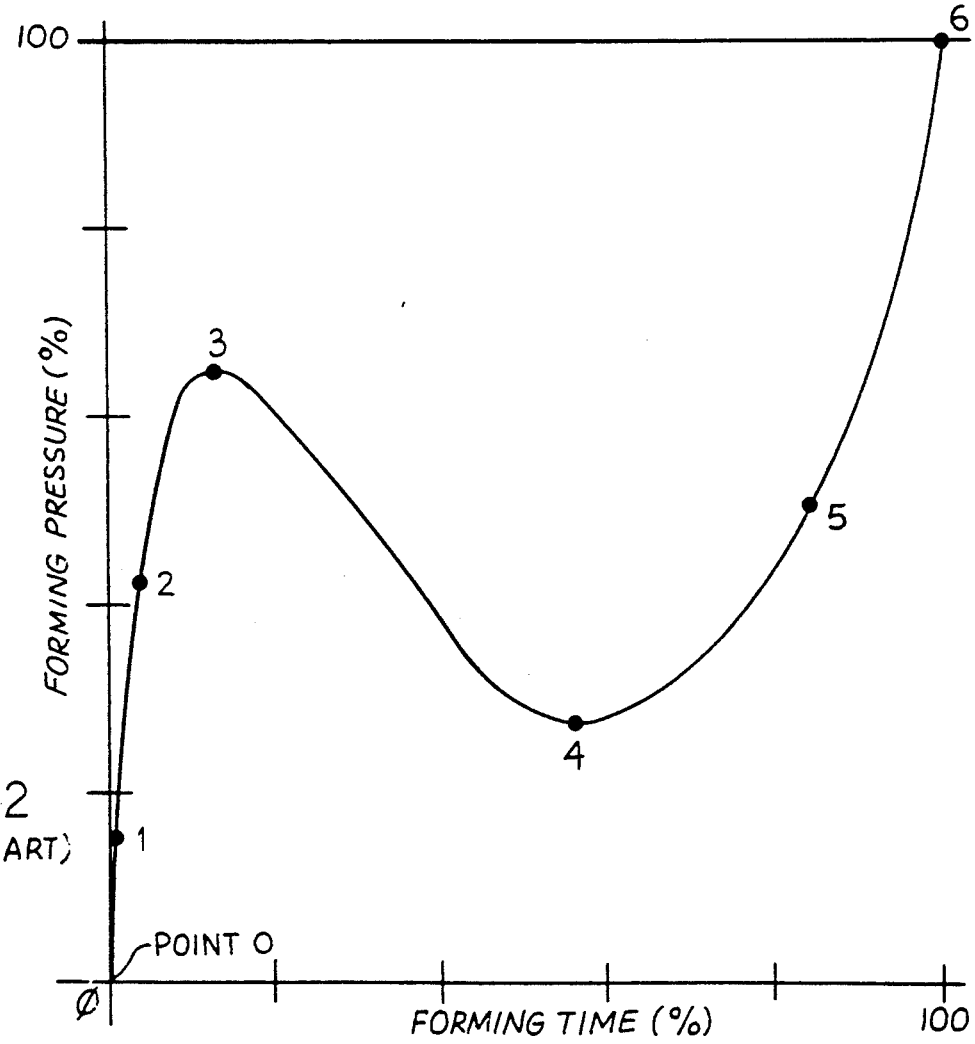
FIG. 2 (PRIOR ART)
FIG. 2 is a graph of forming pressure versus time for the superplastic forming, at a constant strain rate, of the deep cup shown in FIG. 1. This illustrates the type of relationship between forming pressure and time used in the prior art.
Figure 3:
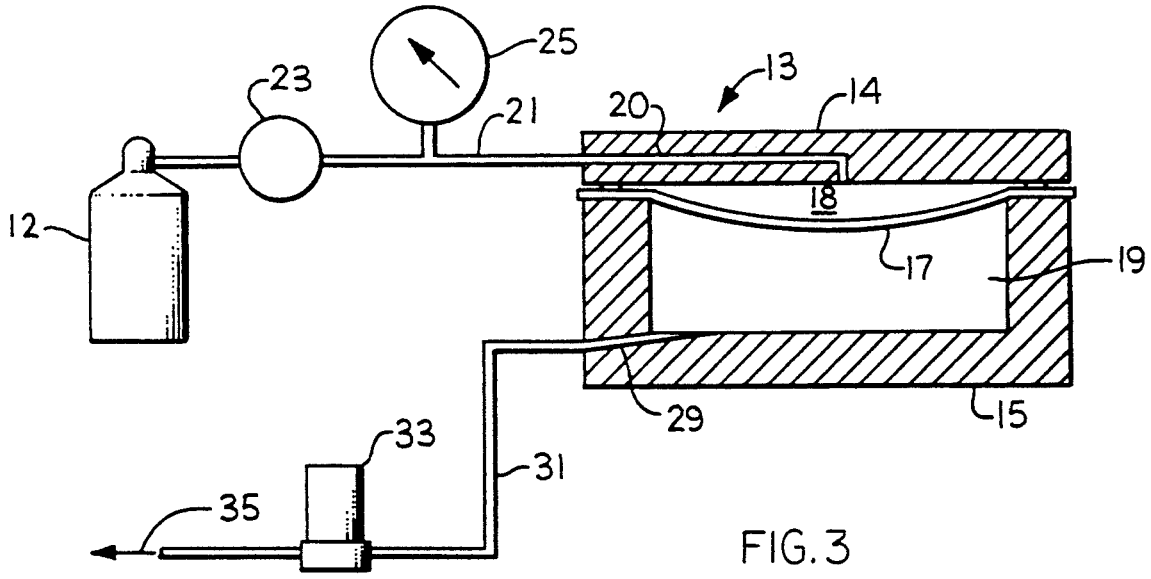
FIG. 3 schematically shows superplastic forming apparatus, including a forming die containing a die cavity, and a gas mass flow meter fluidly communicating with the die cavity.

Turning to FIG. 3, a drawing which schematically illustrates an embodiment of the invention, pressure source 12 contains a pressurized inert gas. Forming die 13 is comprised of cover 14 and lower section 15. Blank 17 is composed of a metallic alloy which, when heated to the proper elevated temperature range, exhibits superplastic characteristics. Blank 17 is positioned in forming die 13 so that its edges are tightly held between cover 14 and lower section 15.

Space 18 is a variable volume contained by blank 17 and cover 14. Cavity 19 is a cavity formed by lower section 15. Space 18 and cavity 19 do not fluidly communicate. Space 18 is minimal before the forming process is initiated and expands during the forming process, while the volume contained by cavity 19 and blank 17 concomitantly decreases during the forming process. Although not shown in this description, cavity 19 could contain a male die whose configuration would be determined by the shape of the object to be formed.

Input port 20 is an opening in cover 14 providing for fluid communication with space 18. Input line 21 fluidly communicates pressure source 12 with space 18 through input port 20. Pressure regulator 23 regulates pressure in input line 21 and space 18. Pressure gage 25 fluidly communicates with input line 21 in between pressure regulator 23 and input port 20, and thus measures the pressure in space 18.

Exhaust port 29 is an opening in cavity 19. Exhaust port 29 initially communicates with input line 21 to fill cavity 19 with inert gas from pressure source 12. Before the forming cycle is commenced, exhaust port 29 is connected with exhaust line 31, as shown in the drawing. Flow meter 33 is a gas mass flow meter which provides both the instantaneous gas mass flow rate and the cumulative gas mass which has flowed through the flow meter. Exhaust line 31 provides for fluid communication between exhaust port 29, and therefore cavity 19, and flow meter 33.

After passing through flow meter 33, exhaust gas 35 is exhausted into the ambient atmosphere. Should the metallic alloy of blank 17 be susceptible to oxidation at the temperatures required for superplastic forming, a line may be used to fluidly communicate flow meter 33 with a water reservoir (not shown). If this modification is employed, exhaust gas 35 will pass through the water contained by the water reservoir before entering the ambient atmosphere. Air will thereby be prevented from flowing into cavity 19. Cavity 19 will remain at ambient atmospheric pressure.

Blank 17 is heated to a superplastic forming temperature by forming die 13. Superplastic forming of blank 17 occurs when pressure regulator 23 permits pressurized inert gas from pressure source 12 to flow into space 18, creating stress in blank 17 due to the difference between the pressure in space 18 and the ambient atmospheric pressure in cavity 19. Blank 17 is shown partially formed into the cylinder to be produced by the superplastic forming process described herein.

The average gas mass flow rate that will be exhausted through flow meter 33 is calculated by dividing the total mass of gas that will be forced out of cavity 19 during the forming cycle, by the time that will be required to complete the forming cycle. This time is known as the forming cycle period. The volume of cavity 19 is calculated or measured. The mass of inert gas contained in cavity 19 is calculated from the foregoing volume. This is the mass of gas that will be exhausted through flow meter 33 during the forming cycle period.

The forming cycle period is determined based on the superplastic properties of the metallic alloy of which blank 17 is composed and the geometry of the object to be formed, using empirical data and methods known to practitioners of superplastic forming. For example, the forming of a cup composed of the metallic alloy Ti-6Al-4V will take approximately from fifteen to thirty minutes where the ratio of the cup's depth to its radius is one. This range is typically independent of the thickness of the blank. For a depth to radius ratio of less than one, the forming cycle period would tend to be shorter. Deep forming involves a cup for which the depth to radius ratio is greater than one, and for this type of cup the forming cycle period would tend to be longer.

Flow meter 33 is continuously monitored during the forming cycle. The forming pressure is regulated by adjusting pressure regulator 23 so that the instantaneous gas mass flow rate measured by flow meter 33 approximates the predetermined average gas mass flow rate. Alternatively, a signal is generated by flow meter 33 and fed back to pressure regulator 23, whereupon pressure regulator 23 is automatically adjusted to obtain the foregoing mass flow rate through flow meter 33.

If the forming process must be stopped due to an equipment malfunction, the forming cycle may be resumed after the interruption with monitoring of flow meter 33 and appropriate adjustment of the forming pressure by means of pressure regulator 23 in the same manner as before the interruption in the forming cycle. The completion of the forming cycle is indicated when the cumulative gas mass flow shown by flow meter 33 equals the total mass of gas that will be forced out of cavity 19, or when the gas mass flow rate drops to zero.

Typically, if the measured gas mass flow rate approximates the average gas mass flow rate, the maximum strain rate for any part of the blank will not be exceeded and rupture will not occur, with the following caveat. In the unusual case of the object being formed requiring a large die cavity and having a relatively sharp corner having a small radius that will be the last section formed, the actual gas mass flow rate may drop below the average gas mass flow rate near the very end of the forming cycle. This would call for the forming pressure to be increased to raise the gas mass flow rate up to the average.

A very small gas mass would be remaining in the forming cavity at this point, and an ordinary increase in the forming pressure might not raise the gas mass flow rate up to the average mass flow rate. In this situation, the forming pressure should not be significantly increased in an attempt to raise the gas mass flow rate up to the average gas mass flow rate because to do so might result in the rupture of the blank at the corner. Instead, near the end of the forming cycle a lower average gas mass flow rate should be selected or a forming pressure should be used which is lower than that called for to maintain the average gas mass flow rate. The foregoing procedural modification should be continued until the forming is completed as indicated by the gas mass flow rate decreasing to zero.

The foregoing discussion explains how the invention can be used in conjunction with forming that is controlled by regulating the forming pressure. The invention can also be used in the same manner and with the same equipment in conjunction with the superplastic forming method and apparatus shown by Yasui in U.S. patent application Ser. No. 636,791. The foregoing patent application shows controlling the rate of forming by measuring and regulating the mass flow rate of inert gas into the space between the die cover and the blank. In such a context, the measurement of the exhaust gas mass flow rate by the apparatus of the present invention can be used to regulate the mass flow rate of inert gas into the space between the die cover and the blank.

Although the described embodiment of the invention explains its use in conjunction with the superplastic forming of a blank composed of a metallic alloy, the forming apparatus and process of the present invention can also be used to the same advantage in conjunction with the forming of a blank composed of a nonmetallic material, such as plastic.

Changes and modifications to the specifically described embodiment of the invention may be made without departing from the scope of the invention. Accordingly, it should be clearly understood that the form of the invention previously described and shown in the drawings is illustrative only and is not intended to limit the scope of the invention.

What is claimed is:

1. An apparatus for superplastically forming a blank into an object during a forming cycle period comprising:

a forming die containing the blank;

means for controlling the superplastic forming of the blank;

an exhaust gas being exhausted from the forming die at an actual mass flow rate;

means for measuring the actual mass flow rate of the exhaust gas;

means for determining an average mass flow rate of the exhaust gas for the forming cycle period; and means for continuously comparing the average mass flow rate and the actual mass flow rate of the exhaust gas; wherein said control means is responsive to said comparison means.

2. The superplastic forming apparatus recited in claim 1 wherein said control means causes the actual mass flow rate to tend towards the average mass flow rate.

3. The superplastic forming apparatus recited in claim 1 wherein:

said comparison means obtains a difference between the actual mass flow rate and the average mass flow rate;

a signal is generated by said comparison means, the signal being a function of the difference between the actual mass flow rate and the average mass flow rate;

the signal is communicated to said control means; and said control means regulates the superplastic forming responsive to the signal.

4. The superplastic forming apparatus recited in claim 1 wherein said measuring means is a gas mass flow meter.

5. The superplastic forming apparatus recited in claim 1 wherein:

the forming die is surrounded by an ambient atmosphere; and further comprising means for fluidly communicating the exhaust gas with the ambient atmosphere.

6. The superplastic forming apparatus recited in claim 5 further comprising means for preventing the ambient atmosphere from flowing into the forming die.

7. The superplastic forming apparatus recited in claim 1 further comprising:

a forming gas flowing into the forming die at a mass flow rate; wherein said control means is means for regulating the mass flow rate of the forming gas.

8. The superplastic forming apparatus recited in claim 1 further comprising:

a forming pressure in the forming die forcing the superplastic forming of the blank; wherein said control means is means for regulating the forming pressure.

9. An apparatus for superplastically forming a blank into an object comprising:

a forming die containing the blank;

means for controlling the superplastic forming of the blank;

an exhaust gas being exhausted from the forming die at a mass flow rate;

means for measuring the mass flow rate of the exhaust gas;

said control means being responsive to the mass flow rate of the exhaust gas;

the forming die being surrounded by an ambient atmosphere; and means for fluidly communicating the exhaust gas with the ambient atmosphere.

10. The superplastic forming apparatus recited in claim 9 further comprising means for preventing the ambient atmosphere from flowing into the forming die.

11. The superplastic apparatus recited in claim 9 wherein said measuring means is a gas mass flow meter.

12. The superplastic forming apparatus recited in claim 9 further comprising:

a forming gas flowing into the forming die at a mass flow rate; wherein said control means is means for regulating the mass flow rate of the forming gas.

13. The superplastic forming apparatus recited in claim 9 further comprising:

a forming pressure in the forming die forcing the superplastic forming of the blank; wherein said control means is means for regulating the forming pressure.

14. An apparatus for superplastically forming a blank comprising:

a forming die containing the blank;

an exhaust gas being exhausted at a mass flow rate from the forming die during superplastic forming;

means for controlling the superplastic forming of the blank; and means for measuring the instantaneous mass flow rate of the exhaust gas; wherein said control means is responsive to the instantaneous mass flow rate of the exhaust gas.

15. The superplastic forming apparatus recited in claim 14 further comprising:

a forming pressure in the forming die; wherein said control means is means for regulating the forming pressure.

16. The superplastic forming apparatus recited in claim 14 further comprising:

a forming gas flowing into said forming die at a mass flow rate; wherein said control means is means for regulating the mass flow rate of the forming gas.

17. The superplastic forming apparatus recited in claim 14 wherein said measuring means is a gas mass flow meter.

18. The superplastic forming apparatus recited in claim 14 wherein:

the forming die is surrounded by an ambient atmosphere; and further comprising means for fluidly communicating the exhaust gas with the ambient atmosphere.

19. A method for superplastically forming a blank during a forming cycle period, comprising:

continuously measuring a mass flow rate for an exhaust gas being exhausted from a forming die while the blank is being superplastically formed in the forming die;

determining an average mass flow rate for the exhaust gas for the forming cycle period, before the forming cycle period begins;

continuously comparing the measured mass flow rate with the average mass flow rate; and controlling the superplastic forming of the blank responsive to the comparison of the measured mass flow rate with the average mass flow rate of the exhaust gas.

20. The method for superplastic forming recited in claim 19 further comprising controlling the superplastic forming of the blank so that the measured mass flow rate tends towards the average mass flow rate.

21. The method of superplastic forming recited in claim 19 further comprising:

determining the forming cycle period;

determining a mass of the exhaust gas that will be exhausted during the forming cycle period; and determining the average mass flow rate by dividing the mass of exhaust gas by the forming cycle period.

22. The method of superplastic forming recited in claim 21 further comprising:

determining a volume of the exhaust gas that will be displaced by the blank and exhausted from the forming die during the forming cycle period;

determining a density of the exhaust gas;

determining the mass of the exhaust gas by multiplying the volume of the exhaust gas by the density of the exhaust gas.

23. The method for superplastic forming recited in claim 19 further comprising controlling the superplastic forming of the blank by regulating a forming pressure in the forming die.

24. The method for superplastic forming recited in claim 19 further comprising controlling the superplastic forming of the blank by regulating a mass flow rate of a forming gas flowing into the forming die.

25. The method for superplastic forming recited in claim 19 further comprising exhausting the exhaust gas to an ambient atmosphere surrounding the forming die.

26. A method for superplastically forming a blank comprising:

continuously measuring a mass flow rate for an exhaust gas being exhausted from a forming die to an ambient atmosphere surrounding the forming die, while the blank is being superplastically formed in the forming die; and controlling the superplastic forming of the blank responsive to the mass flow rate of the exhaust gas.

27. The method for superplastic forming recited in claim 26 further comprising controlling the superplastic forming of the blank by regulating a forming pressure in the forming die.

28. The method for superplastic forming recited in claim 26 further comprising controlling the superplastic forming of the blank by regulating a mass flow rate of a forming gas flowing into the forming die.

29. A method for superplastically forming a blank comprising:

continuously measuring an instantaneous mass flow rate for an exhaust gas being exhausted from a forming die while the blank is being superplastically formed in the forming die; and controlling the superplastic forming of the blank responsive to the instantaneous mass flow rate of the exhaust gas.

30. The method for superplastically forming a blank recited in claim 29 further comprising exhausting the exhaust gas to an ambient atmosphere surrounding the forming die.

* * * * *